United States Patent [19]

Fournie et al.

[11] 4,444,527

[45] Apr. 24, 1984

[54] COLLAR FORMING MACHINE FOR SUBMERGED PIPELINES

[75] Inventors: Rene Fournie, Pau; Francois Besnard, Lescar, both of France

[73] Assignee: Societe Nationale ELF Aquitaine (Prod.), Courbevoie, France

[21] Appl. No.: 384,555

[22] Filed: Jun. 3, 1982

[30] Foreign Application Priority Data

Jun. 9, 1981 [FR] France ..... 81 11286

[51] Int. Cl.[3] ..... F16L 35/00

[52] U.S. Cl. ..... 405/170; 72/316; 285/39; 29/237; 405/169

[58] Field of Search ..... 405/168, 169, 170, 171; 72/125, 316, 318; 24/237, 243.52; 285/334.5, 39

[56] References Cited

U.S. PATENT DOCUMENTS

| | | | |
|---|---|---|---|
| 3,031,007 | 4/1962 | Temple et al. | 72/318 |
| 3,412,592 | 11/1968 | Ramsay | 72/316 |
| 3,466,738 | 9/1969 | Mount | 29/237 X |
| 3,660,884 | 5/1972 | Kowal | 29/237 |
| 3,820,375 | 6/1974 | Koski | 72/318 |
| 3,913,364 | 10/1975 | Strybel | 72/316 X |
| 4,109,945 | 8/1978 | Manchester et al. | 285/323 |
| 4,183,555 | 1/1980 | Martin | 285/39 |

*Primary Examiner*—Dennis L. Taylor

*Attorney, Agent, or Firm*—Poms, Smith, Lande & Rose

[57] ABSTRACT

A collar forming machine for the repair of submerged pipelines is provided comprising a forming module having the central shaft (10) passing through the body (12) of a main jack, a piston (18) sliding on the shaft and carrying at its end a forming punch (13), the shaft carrying in its part intended to penetrate inside the tube to be repaired internal locking means (14) to be forcefully applied to the inner face of the wall of the tube and capable of transferring the forming force to the tube itself, further comprising external locking means (17) applied to the external face of the wall of the tube to prevent deformation thereof.

15 Claims, 5 Drawing Figures

COLLAR FORMING MACHINE FOR SUBMERGED PIPELINES

The present invention relates to the repair of submerged pipelines transporting fluids, such as gas and oil or derivatives thereof, more especially the repair of oil pipelines and gas pipelines, by means of a mechanical coupling.

Mechanical connectors are known providing both anchorage on the tube to be repaired and the tightness of the junction. One of these connectors provides anchoring by means of oblique ramp jaws bearing on the tube and on the bore of the connector. The gaskets clamped during locking of the jaws provide sealing of the connector.

Such connectors present sealing defects when they are exposed to high pressure and temperature variations due more especially to creeping of the gaskets.

In fact, to obtain a durable seal it is necessary to use a metallic seal.

Now, the tightness of the metal-metal junction cannot be efficiently ensured between the tube and the connector, whether in the reduced annular space owing to the tolerances of the tube, or on the edge of the section of the tube, the thickness of the tube being too limited and not perfectly circular.

One of the aims of the invention is to provide a junction ensuring efficient anchorage and good sealing by equipping the end of the tube with a collar which increases the bearing surface of the metal seal.

When a collar has been formed at the end of the tube, particularly when it is a question of replacing a defective section, said end may be connected to an insert tube with interposition of the seal by using known assembly devices, such as flange or counterflange or similar.

The operation for forming a collar on an end of the tube is a relatively simple operation, if it can be carried out in a workshop by means of a stamping press. On the other hand, when it is a question of operating on the seabed at considerable depths, for example greater than 200 meters, such an operation requires a forming machine adapted to working in a sea environment, the automatic working of which is provided by remote control from a floating structure or a submarine.

The invention has for object an automatic collar forming machine remote controlled for operating under water, as well as a process for using such a machine.

It is characterized in that it comprises a forming module having a central shaft passing through the body of a main piston and cylinder device, or jack, a piston of the jack sliding on the shaft and carrying at its end a forming punch, whose angle is adapted to the desired slope for the collar, the central shaft carrying in its part intended to penetrate inside the tube to be repaired internal locking means intended to be forcefully applied on the inner face of the wall of the tube and capable of transferring the forming force on the tube itself, further comprising external locking means which are applied on the external face of the wall of the tube to avoid deformation thereof.

Other characteristics of the invention will appear from the following description illustrating different arrangements of the invention.

Figure 1:
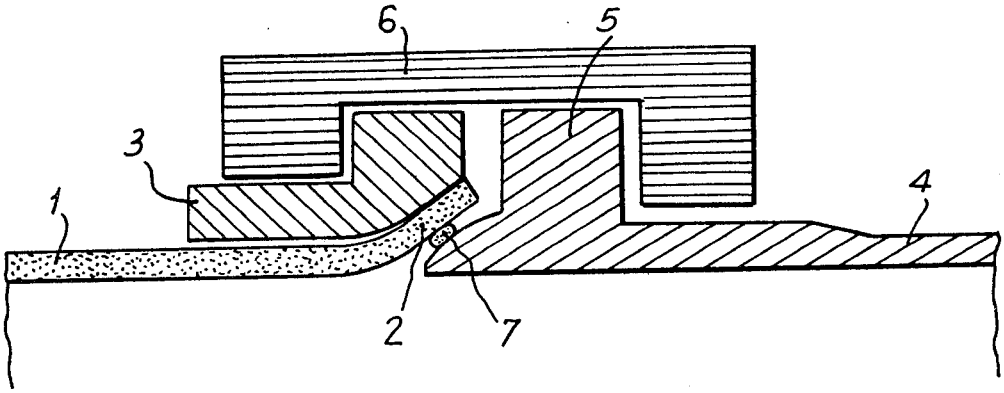
FIG. 1 shows a mechanical collar coupling in schematical section.
Figure 4:
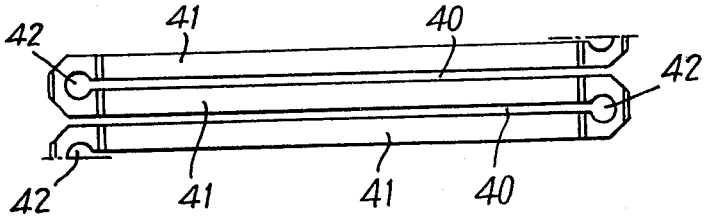
FIG. 4 is a view of the face of an expandable ring for engagement with the tube to be repaired.
Figure 5:
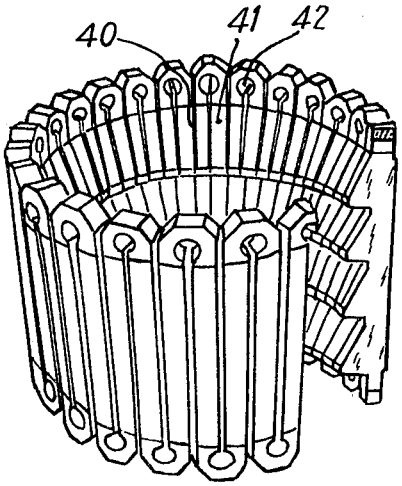
FIG. 5 is a perspective view of an expandable ring of the internal locking device of the tube.

One end of a tube 1, which has been cut so as to remove therefrom the defective part, has been widened out to form a collar 2, against which is applied a flange 3. An insert tube 4 which must be assembled with tube 1 is provided with a counterflange 5, flange 3 and counterflange 5 being locked together by clamping with an assembly device 6. The profile of the end of the insert tube is adapted so that the bearing surface of seal 7 placed between this end and the inner face of the collar is sufficient to provide a good seal at the junction.

Figure 2:
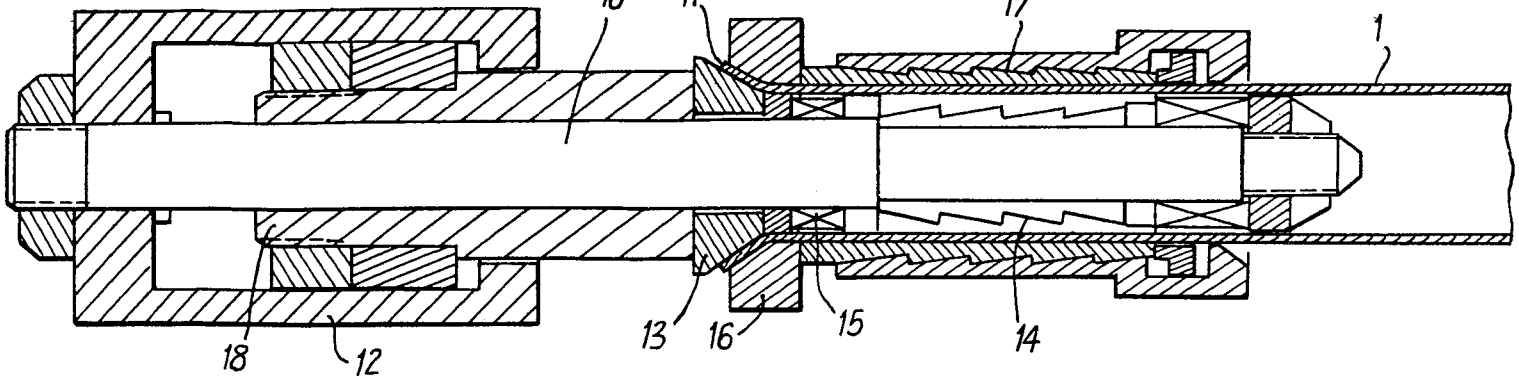
FIG. 2 shows a general view in axial section of the collar forming machine in accordance with the invention.
Figure 3:
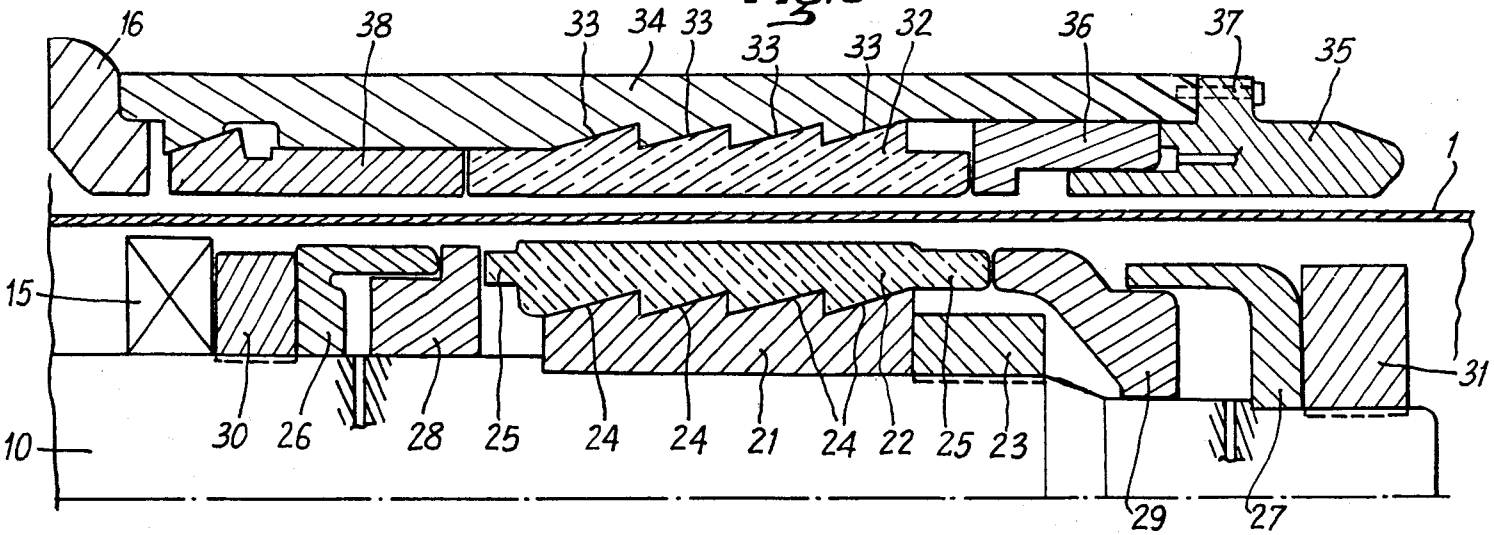
FIG. 3 shows in axial section half of the part of the central shaft which penetrates inside the tube to be repaired.

The machine for forming a collar 11 on the tube to be repaired 1 is shown in FIG. 2. This machine comprises a forming module having the central shaft 10 passing through the body 12 of a main jack. The piston 18 of the jack slides freely on shaft 10 and carries at its end a punch 13 whose angle is adapted to the slope desired for collar 11. Shaft 10 carries in its part which penetrates inside the tube to be repaired an internal locking device 14 capable of transferring the forming force on the tube itself and comprising two concentric rings 21 and 22 (FIG. 3).

The rigid ring 21 is interlocked with the shaft by means of the nut 23. Its outer face has a profile in the shape of four conical ramps 24 sloping in the same direction and at the same angle. An expandable ring 22 surrounds ring 21 and has on its inner face a profile complementary in shape to the four identically sloping conical ramps. On two opposite sides, ring 22 has extensions 25 by means of which it may be urged under an axial thrust. On two sides of the internal locking device 14 are fixed, by means of nuts 30 to 31, to shaft 10, two jack bodies 26 and 27, whose pistons 28 and 29 will each exert an axial thrust in opposite directions on ring 22.

The external locking means 17 of the tube comprise an expandable ring 32 whose outer face has a profile in the shape of four conical ramps 33 sloping in the same direction and at the same angle. A single side of the ring carries an extension for receiving an axial thrust. Around the expandable ring 32 is placed a rigid ring 34, on which bears through bolt 37 a jack body 35 containing a piston 36 for actuating the expandable ring in a single direction. The rigid ring 34 has on its inner face a profile complementary in shape to the four conical ramps. An insert ring 38 sliding on the tube 1 wedges the expandable ring 32 in its endmost position against a die flange 16.

Shaft 10 carries upstream of the internal locking means a hydroforming seal 15, whose role will be explained further on.

The lateral end ring 34, more especially the end opposite the one to which jack body 35 is fixed, is intended to engage the die flange 16, which is fitted onto the end of the tube on which the collar is to be provided.

Expandable rings 22 and 32, one of whose faces has a profile of several conical ramps, have a special structure for increasing their radial elasticity. They are formed by making cuts 40 in a metal sleeve, which cuts separate strips 41 which are connected together alternately at opposite ends by loops 42. Loops 42 may serve at the same time as extensions 25 on which the jack pistons bear.

The face of each expandable ring intended to engage the wall of the tube may be scored to improve anchorage to the tube.

The slope angle of the conical ramps of ring 22 is about 20 degrees, whereas that of the slopes of the conical ramps of ring 32 may be limited to 10 degrees, since this ring will not be deactivated after formation of the collar.

The operation of the machine is as follows. Over the end of the tube to be repaired is fitted the external locking device 17 comprising rings 32 and 34, insert ring 38 and the die flange 16, the jack body 35 being fixed to ring 34 by means of screws 37. The front part of the central shaft carrying the two jacks 26 and 27 and rings 21 and 22 is inserted inside tube 1. Jacks 26 and 35 are actuated so that expandable rings 22 and 32 slide over conical ramps and clamp tube 1 on both sides. When the operation takes place under water, it is recommended to use a hydroforming seal, such as shown in 15, placed on the shaft 10 upstream of the locking means. Its role is to stop up the entrance of the tube, for the expandable rings provided with cuts do not ensure sealing under water. Once in position, the seal cooperates, during the action of punch 13, in compressing the volume of water in the vicinity of the internal part of the tube where the collar is to be formed and in transmitting to the walls of the tube the whole of the internal pressure resulting from the advance of the punch. The provision of a bell mouth in the shape of a collar will be thus greatly facilitated.

The hydroforming seal 15 is actuated for its positioning and the main jack 12 is actuated. Piston 18 slides freely on shaft 10 and its punch 13 produces the widening out of the tube until engagement with the die flange 16 is obtained. This advance of the piston maintains the pressure of the volume of water between the seal and the punch.

When the operation is terminated, jack 27 is actuated to loosen the contact between ring 22 and the inner wall of the tube and the shaft is withdrawn longitudinally from inside the tube.

The external locking device 17 remains in place and is not recovered, whereas the die flange 16 will remain to serve for the mechanical coupling.

During the formation of collars for repairing submerged pipelines, the process for using the machine of the invention comprises placing worktables on the seabed, by means of which the ends of the tubes to be connected to an insert tube are gripped and positioned, and descending the forming machine by means for example of a whipple-tree and fixing thereof on the worktable. The forming machine is centered in the axis of the tube to be repaired, the die flange and the external locking means are placed on the outside of the tube, then a part of the central shaft carrying the internal locking device is introduced inside the tube. The internal and external expandable locking rings are actuated by jacks, the hydroforming seal is positioned and the main jack is actuated. When the collar has been formed, the ring of the internal locking device is deactivated, the forming machine is withdrawn and the machine and worktable are brought up to the surface.

All these operations may be carried out by remote control, by means of control relays transmitting to a floating structure images of the operation.

The invention is not limited to the embodiment described and numerous variations may be made thereto without departing from the scope and spirit of the invention.

In particular, the number of conical ramps provided on the expandable rings and the slope thereof may be chosen depending on factors related to the force to be exerted and the friction coefficient of the ramps.

The jacks for actuating the expandable rings may be of different types, for example circular jacks, as shown in the embodiment described.

We claim:

1. A machine for forming collars serving for the repair of submerged pipelines transporting fluids, by means of a mechanical coupling, characterized in that it comprises a collar forming module having a central shaft (10) passing through the body (12) of a main jack, a piston (18) of the jack sliding on the shaft and carrying at its end a forming punch (13) whose angle is adapted to the slope desired for the collar to be formed on a tube, the shaft (10) carrying internal locking means (14) to be forcefully applied to the inner face of the wall of the tube (1) and capable of transferring the forming force to the tube itself, and further comprising external locking means (17) having a clamping means applied to the external face of the wall of the tube opposite the internal locking means (14) so as to avoid deformation of a portion of the tube adjacent the collar to be formed.

2. The machine according to claim 1, characterized in that the internal locking means comprise a rigid ring (21) fixed to the shaft (10) and whose outer face has a profile presenting at least one conical ramp (24), the slopes of which have the same direction and the same angle, and an expandable ring (22) surrounding the rigid ring (21) whose internal face has a complementary profile in the shape of at least one conical ramp, and means for actuating the expandable ring (22) carried by shaft 10 whereby expandable ring (22) is axially moved along the slope of the conical ramps to clampingly contact the internal wall of the tube, said actuating means being operable to release the clamping contact for removal of the internal locking means on completion of collar formation.

3. The machine according to claim 1 characterized in that the external locking means (17) comprises an expandable ring 32 whose external face has a profile in the form of at least one conical ramp (33), and the slopes of which are in the same direction and of the same angle, and a rigid ring (34) surrounding the expandable ring (32), whose inner face has a complementary profile in the form of at least one conical ramp, and means at one end of the external locking means for axially moving ring (32) whereby expandable ring (32) exerts a clamping force on the outer face of the tube to prevent deformation thereof.

4. The machine according to claims 2, characterized in that each expandable ring, whose axial section has a profile with conical ramps, is formed by longitudinal strips (41) separated by cuts (40) and connected together alternately at opposite ends by loops (42) conferring on the ring its radial elasticity.

5. The machine according to one of claims 2, characterized in that the face of the expandable ring (22, 32) intended to enter into contact with the wall of the tube to be repaired is scored for improved anchorage to the tube.

6. The machine according to claim 1, characterized in that the means for actuating the expandable ring (22) of the internal locking means comprise two jacks (26, 27 carried on the central shaft and placed at the two opposite lateral ends of the expandable ring, the jack pistons (28, 29) being applied against said ends so that the thrust exerted by one of the jacks causes activation of the ring (22) for clamping against the internal wall of the tube and that the thrust exerted by the other jack causes the deactivation of the ring (22) to cause retraction from the internal wall surface of the tube.

7. The machine according to claim 1, characterized in that the means for actuating the expandable ring (32) of the external locking means of the tube comprise a jack (35) connected with the rigid ring (34) of said external locking means.

8. The machine according to claim 1, characterized in that the central shaft (10) carries upstream of the internal locking means (14) a hydroforming seal (15) for sealingly closing the entrance of the tube at the upstream end of the internal locking means to allow transmission of energy from the punch (13) through the water trapped between the punch and the seal to the part of the tube being shaped as a collar.

9. A collar forming process for the repair of submerged pipelines characterized in that the ends of the pipeline to be connected to an insert tube are gripped in position by means of a worktable placed on the seabed and in that a forming machine associated with a beam is lowered by means of a whipple-tree to the level of the pipeline and is fixed to the worktable, the forming machine is centered on the axis of a tube to be repaired, a die flange and the external locking means are placed on the outside of the tube, the part of the central shaft carrying the internal locking device capable of transferring the forming force to the tube itself is introduced inside the tube, the expandable internal and external locking rings are actuated by means of jacks, a hydroforming seal is positioned adjacent one end of the tube, the main forming jack is actuated then, when the collar is has been formed, the internal locking ring is deactivated and the forming machine is withdrawn longitudinally and the machine and the worktable are brought again to the surface.

10. A collar forming machine for use under subsea conditions to form a flared collar on the end of a tube, comprising in combination:

a shaft having an end portion;

an internal locking means carried on the shaft end portion and positionable within one end of the tube;

jack means carried on the shaft and having a piston provided with a forming punch for pressing against said end of the tube;

external locking means on said tube;

a forming die positioned at said end of the tube to oppose said punch;

said internal and external locking means including radial displaceable means for clamping against internal and external surfaces of the tube respectively to prevent deformation of the tube during forming of the flared collar at the end of the tube upon pressing said punch against the tube end at the forming die.

11. A machine as stated in claim 10 wherein said clamping means includes:

a rigid ring carried by said shaft;

a radially outwardly expandable clamp ring over said rigid ring for contact with internal surfaces of said tube;

an outer rigid ring;

an inner radially inwardly contractible clamp ring within said outer rigid ring for contact with exterior surfaces of the tube;

said rigid rings and clamp rings having interengageable conical ramps for radial movement of the clamp rings upon application of axial forces to the clamp rings for clamping against said tube surfaces.

12. A machine as stated in claim 11 wherein said forming die abuts the end of said outer rigid ring and is adapted to provide a coupling collar when said external locking means is retained on said end of said tube.

13. A machine as stated in claim 11 including jack means for applying forces in an axial direction to actuate said locking means.

14. A machine as stated in claim 10 including hydroform seal means between said punch and one end of said internal locking means whereby water trapped between the seal means and the punch transmits forces from the punch to the end of the tube on which the collar is formed.

15. A process for forming a collar on the end of a tube for the repair of submerged pipelines including the steps of:

placing an external locking means and a die flange on the outside of the tube at the end thereof on which the collar is to be formed;

inserting a shaft axially of the tube end;

positioning an internal locking device carried by the shaft end opposite the external locking means;

radially displacing an external locking ring on the internal locking means to press against the interior surface of the tube end;

radially displacing an inner locking ring on the external locking means to press against the outer surface of the tube end;

positioning a hydroforming seal at the outer end of the internal locking means;

and actuating a jack means carrying a forming punch against the end of the tube to be provided with a flared collar.

* * * * *

UNITED STATES PATENT AND TRADEMARK OFFICE

CERTIFICATE OF CORRECTION

PATENT NO. : 4,444,527

DATED : April 24, 1984

INVENTOR(S) : Rene Fournie, Francois Besnard

It is certified that error appears in the above-identified patent and that said Letters Patent are hereby corrected as shown below:

The name of the assignee is "Societe Nationale Elf Aquitaine (Production)" instead of "Societe Nationale Elf Aquitaine (Prod.)".

Signed and Sealed this

*Eighteenth* Day of *December 1984*

[SEAL]

*Attest:*

*Attesting Officer*

GERALD J. MOSSINGHOFF

*Commissioner of Patents and Trademarks*